US011668150B2

(12) United States Patent
Szpunar et al.

(10) Patent No.: US 11,668,150 B2
(45) Date of Patent: Jun. 6, 2023

(54) VALVE ASSEMBLY FOR CONTROLLING FLUID COMMUNICATION ALONG A WELL TUBULAR

(71) Applicant: Expro North Sea Limited, Aberdeenshire (GB)

(72) Inventors: Dariusz Krzysztof Szpunar, Westhill (GB); Andre Nicolaas Duplessis, Aberdeen (GB); Kris Manett, Fraserburgh (GB)

(73) Assignee: Expro North Sea Limited, Dyce (GB)

( * ) Notice: Subject to any disclaimer, the term of this patent is extended or adjusted under 35 U.S.C. 154(b) by 0 days.

(21) Appl. No.: 17/787,470

(22) PCT Filed: Dec. 16, 2020

(86) PCT No.: PCT/GB2020/053233

§ 371 (c)(1),
(2) Date: Jun. 20, 2022

(87) PCT Pub. No.: WO2021/123764

PCT Pub. Date: Jun. 24, 2021

(65) Prior Publication Data

US 2023/0036622 A1 Feb. 2, 2023

(30) Foreign Application Priority Data

Dec. 19, 2019 (GB) ..... 1918790

(51) Int. Cl.
*E21B 33/035* (2006.01)
*E21B 33/064* (2006.01)
(Continued)

(52) U.S. Cl.
CPC ..... *E21B 33/0355* (2013.01); *E21B 29/08* (2013.01); *E21B 33/064* (2013.01); *E21B 34/045* (2013.01)

(58) Field of Classification Search
CPC .... E21B 33/0355; E21B 29/08; E21B 33/064; E21B 34/05
See application file for complete search history.

(56) References Cited

U.S. PATENT DOCUMENTS 4,467,833 A * 8/1984 Satterwhite ..... E21B 33/0355 251/63.4
4,565,349 A * 1/1986 Tomlin ..... F16K 17/048 251/63.4

(Continued)

*Primary Examiner* — Aaron L Lembo
(74) *Attorney, Agent, or Firm* — Getz Balich LLC

(57) ABSTRACT

A valve assembly for controlling fluid communication along a well tubular that includes hydraulically operated valve that includes a valve member movable between open and closed positions, and a hydraulic actuator for moving the valve member; a control system for selectively controlling the flow of hydraulic fluid to and from the actuator; a vent chamber for selectively receiving hydraulic fluid exhausted from the actuator when the valve member is moved to its closed position; and a vent conduit for selectively receiving hydraulic fluid exhausted from the actuator when the valve member is moved to its closed position. The control system has a first valve closing state in which the vent chamber is isolated from the actuator. The control system has a second valve closing state in which fluid exhausted from the actuator during movement of the valve member to its closed position is vented into the vent chamber.

20 Claims, 5 Drawing Sheets

(51) Int. Cl.
*E21B 34/04* (2006.01)
*E21B 29/08* (2006.01)

(56) References Cited

U.S. PATENT DOCUMENTS

| | | | | |
|---|---|---|---|---|
| 4,637,419 | A * | 1/1987 | Hughes | F16L 37/002 251/63.5 |
| 4,817,669 | A | 4/1989 | Barrier | |
| 7,159,662 | B2 * | 1/2007 | Johansen | E21B 34/16 166/374 |
| 9,004,178 | B2 * | 4/2015 | Leuchtenberg | E21B 19/006 166/345 |
| 9,422,783 | B2 * | 8/2016 | Gustafson | E21B 33/0355 |
| 9,605,502 | B2 * | 3/2017 | Leuchtenberg | E21B 17/01 |
| 10,132,135 | B2 * | 11/2018 | Gaude | E21B 33/0355 |
| 10,309,191 | B2 * | 6/2019 | Leuchtenberg | E21B 34/04 |
| 10,876,369 | B2 * | 12/2020 | Holmes | G05B 9/03 |
| 11,015,411 | B2 * | 5/2021 | Tesla | E21B 33/038 |
| 11,072,988 | B2 * | 7/2021 | Deacon | E21B 34/04 |
| 11,396,784 | B2 * | 7/2022 | Szpunar | E21B 33/0355 |
| 2011/0005770 | A1 | 1/2011 | Scranton | |
| 2017/0152723 | A1 | 6/2017 | Deacon | |
| 2017/0343019 | A1 | 11/2017 | Thomson | |

* cited by examiner

VALVE ASSEMBLY FOR CONTROLLING FLUID COMMUNICATION ALONG A WELL TUBULAR

This application claims priority to PCT Patent Appln. No. PCT/GB2020/053233 filed Dec. 16, 2020, which claims priority to GB Patent Appln. No. 1918790.5 filed Dec. 19, 2019, which are hereby incorporated herein by reference in their entireties.

BACKGROUND OF THE INVENTION

1. Technical Field

The present invention relates to a valve assembly for controlling fluid communication along a well tubular.

2. Background Information

In the oil and gas exploration and production industry, wellbore fluids comprising oil and/or gas are recovered to surface through a wellbore which is drilled from surface. The wellbore is lined with metal wellbore-lining tubing, which is known in the industry as casing. The casing is cemented in place within the drilled wellbore and serves numerous purposes including supporting drilled rock formations; preventing undesired ingress/egress of fluid and providing a pathway through which further tubing and downhole tools can pass.

Numerous tubing strings and tools are run-in to the well during a procedure to complete the well in preparation for production, as well as during subsequent production of well fluids, and any intervention procedures which may need to be carried out during the lifetime of the well. For example, well fluids are recovered through production tubing which is installed within the cased well, extending from the surface to the region of a producing formation. Tool strings can be run-into the well, carrying downhole tools for performing particular functions within the well. Coiled tubing and wireline or slickline can be employed as an efficient method of running a downhole tool into a well.

Safety legislation requires the provision of a blow-out preventer (BOP), comprising an arrangement of shear and seal rams, which provides ultimate pressure control of the well. In an emergency situation seal rams can seal around tubing extending through the BOP, to seal an annulus around the tubing. If required, shear rams can be activated to sever tubing and/or wireline extending through the BOP, to shut-in in the well.

Other valve assemblies are provided as part of tubing strings that are run-into and located within the well. Examples include subsurface safety valves (SSSVs), which are typically installed in an upper part of the wellbore, and subsea test trees (SSTTs), which are typically installed within the BOP, as well as retainer and lubricator valves. SSSVs and SSTTs provide emergency closure of producing conduits in the event of an emergency situation arising. It is generally preferable to use the SSTTs to close the producing conduits, rather than the BOP. In particular, it is desirable to avoid actuating the BOP shear rams, if possible.

SSSVs and SSTTs comprise a valve or an arrangement of valves which are required to perform a cutting and/or sealing function. This is to ensure safe cutting of tubing (such as coiled tubing) or other equipment extending through the valves, and subsequent sealing of the SSSV/SSTT bore. Numerous different types of valves can be used, but ball-type valves are often preferred. Ball-type valves comprise a ball member which is rotatable between an open position in which a bore of the ball member is aligned with a bore of a housing in which the ball member is mounted, and a closed position in which the bore of the ball member is disposed transverse to the housing bore, thereby closing the valve. Ball-type valves can have a cutting function (to sever tubing or other equipment extending through the bore of the ball), a sealing function, or a cutting and sealing function. Typically, upper and lower SSTTs are provided.

From time to time, it may be necessary to shut down the well, by closing off fluid communication through the producing conduits. This may be achieved particularly using the SSTT valve or valves. In a normal operating situation, any tubing (such as coiled tubing) or other components extending through the SSTT valves is retrieved, and the upper and lower SSTT valves are closed. In an emergency shutdown (ESD), it may be necessary to quickly actuate the SSTT valves, for example to contain an unexpected pressure event. If possible, the tubing or other components are retrieved prior to closing the SSTT valves. However, it may be necessary to close the valves prior to retrieving such tubing, in order to contain the pressure event. Any tubing or other equipment extending through the SSTT valves is severed by a cutting valve of the SSTTs and dropped into the well. In an emergency quick disconnect (EQD), the upper and lower SSTT valves are similarly closed, but BOP shear and seal rams are also actuated. It is preferred to release a landing string carrying the SSTT prior to operating the BOP. However, it can be necessary to operate the BOP quickly, with the result that the BOP shear rams sever a shear sub of the landing string.

The SSTT valves are actuated using hydraulic fluid, supplied from surface via control lines coupled to the SSTT, often employing accumulators. In an offshore environment, these will be located subsea. The SSTT valves failsafe to their closed positions, via a spring coupled to the valve. In the event of a loss of hydraulic control occurring, the spring acts to move the valve to its closed position. However, significant force is required to operate a cutting valve, to sever tubing (or other equipment) located in the valve bore. Significant hydraulic pressure force is applied to the valve, via the control lines/accumulator, to urge the valve to its closed position, severing the tubing (or other equipment) located in the valve bore.

During Intervention Emergency Shutdown (ESD), a sequenced closure of two valves takes place. A first valve is required to perform the cutting operation. After that has been accomplished, the second valve in the sequence is closed. These two valves require different pressures in order to operate. The cutting valve requires a much higher pressure to operate, due to the cutting requirement. This may typically be in the region of perhaps 4,000 to 8,000 psig. The second valve requires a much lower pressure to close, as the tubing (or other equipment) has already been severed and dropped into the well. The operating pressure for the second valve can be much lower, anything above zero (0) psig being suitable (acting in combination with the valve closure spring).

Usually, the higher the pressure that is applied, the quicker will be the valve closure time. This is significant as the ESD response time should be as short as possible. The volume of fluid that is supplied under high pressure usually comes from subsea accumulators. In an offshore environment in which equipment is deployed from a surface facility through a marine riser to a seabed, space may be limited due to the limitation of having to deploy equipment through the riser. Another limitation comes from the fact that two different pre-charges of accumulator gas would be required for the cutting and the closing operations of the valves (one being relatively high, for the valve that is required to perform the cutting function, and the other being relatively low).

Specifically, a cutting operation requires a relatively low volume of fluid under high pressure, whereas the closing operation of the second valve requires a high volume under relatively low pressure. These two requirements demand different/conflicting pre-charges to be able to perform cut and close. This, together with the fact that the same accumulator is used to deliver fluid for cutting and closing, requires finding just one pre-charge which will work for both cutting and closing operations. As a consequence, the hydraulic system becomes less efficient, with a possible scenario in which it is impossible to set the system to achieve both cutting and closing with one pre-charge.

In addition, during both cutting and closing operations, open chambers of the valves are vented to the marine riser. Accordingly, the minimum pressure (or "reference pressure") that the valves experience is equal to the marine riser pressure. This can be significant, particularly in deep water environments. Very high accumulator pressures can therefore be required in order to overcome this high external reference pressure.

SUMMARY OF THE INVENTION

According to a first aspect of the present disclosure, there is provided a valve assembly for controlling fluid communication along a well tubular, the valve assembly comprising a hydraulically operated valve, a control system, a vent chamber, and a vent conduit. The hydraulically operated valve comprises a valve member which is movable between an open position in which the valve member permits fluid communication along the well tubular and a closed position in which the valve member restricts fluid communication along the well tubular, and a hydraulic actuator associated with the valve member for moving the valve member between its open and closed positions. The control system is for selectively controlling the flow of hydraulic fluid to and from the hydraulic actuator, to operate the valve. The vent chamber is operatively connectable to the hydraulic actuator, for selectively receiving hydraulic fluid that is exhausted from the actuator when the valve member is moved to its closed position. The vent conduit is operatively connectable to the hydraulic actuator, for selectively receiving hydraulic fluid that is exhausted from the actuator when the valve member is moved to its closed position. The vent conduit is exposed to fluid external to the valve assembly at the prevailing external pressure. The control system has a first valve closing state in which the vent chamber is isolated from the hydraulic actuator and hydraulic fluid that is exhausted from the actuator during movement of the valve member to its closed position is vented to an exterior of the valve assembly through the vent conduit. The control system has a second valve closing state in which hydraulic fluid that is exhausted from the actuator during movement of the valve member to its closed position is vented into the vent chamber. The control system is configurable in a selected one of the first and second valve closing states according to an operating requirement of the valve.

The provision of a valve assembly having such first and second valve closing states may have the advantage that hydraulic fluid which is vented from the valve actuator during movement of the valve member to the closed position can selectively be directed into one of the vent conduit and the vent chamber. Venting the fluid to the exterior of the valve assembly through the vent conduit may be sufficient for 'normal' operation of the valve, in which there is no requirement to cut a tubing or other component extending through a bore of the valve. Such operation of the valve may not require a large pressure differential to exist between the hydraulic actuator and the prevailing external reference pressure (which can be relatively high) in order to close the valve. Venting the fluid to the vent chamber may be arranged when there exists a requirement to cut tubing or other components extending through the valve, typically during an ESD or EQD but which may be necessary or desirable in other scenarios. Such operation of the valve may require a large pressure differential to exist between the hydraulic actuator and a reference pressure in the vent chamber in order to close the valve. This can be facilitated by charging the vent chamber with a reference pressure fluid (e.g. a gas such as Nitrogen) which is at a much lower pressure than the prevailing external (reference) pressure.

In the second valve closing state of the control system, the vent conduit may be isolated from the hydraulic actuator, at least from a region or chamber of the actuator from which fluid is exhausted during closing of the valve.

The valve assembly may comprise an accumulator which defines the vent chamber.

The vent chamber may contain a fluid at a pressure which is lower than the prevailing external pressure. The fluid in the vent chamber may provide a reference pressure during operation of the actuator to close the valve. The vent chamber may be a first chamber for receiving hydraulic fluid exhausted from the actuator, and the valve assembly may comprise a second chamber containing a compressible fluid, and an isolating member which separates the second chamber from the first chamber. The accumulator may define the first and second chambers and the isolating member. The compressible fluid may provide a reference pressure during operation of the actuator to close the valve. The fluid/compressible fluid may be a gas, and may an inert gas such as Nitrogen. The fluid in the second chamber may be at a pressure which is lower than the prevailing external pressure. The fluid in the second chamber may be at or near surface atmospheric pressure. The fluid in the first chamber may be at a pressure which is lower than the prevailing external pressure, at least prior to communication between the vent chamber and the actuator being opened (and so prior to de-isolation of the vent chamber). The fluid in the first chamber may be at or near surface atmospheric pressure. The isolating member may serve for communicating a pressure of fluid in the first chamber to fluid in the second chamber. The fluid in the second chamber, and optionally also in the first chamber, may be at a pressure which is lower than the pressure of fluid exhausted from the actuator.

In the second valve closing state of the control system, hydraulic fluid that is exhausted from the hydraulic actuator during movement of the valve member to its closed position may be vented into the first chamber. The valve assembly may comprise a cylinder defining the first and second chambers, and the isolating member may be a piston which is movable within the cylinder so that the first chamber can receive the hydraulic fluid. This may cause the piston to translate within the cylinder, pressurizing the fluid in the second chamber.

The control system may be configurable in the selected valve closing state in response to a control command issued to the system. The control command may be issued from surface. The valve assembly may comprise a controller for issuing the control command to the control system. Issue of the control command may be automated, on detecting a need to close the valve. The control system may be adapted to be configured in the first valve closing state when there is a requirement to close the valve and the valve is unrestricted or unobstructed, in particular a bore of the valve is unrestricted or unobstructed (such as by a component which can be deployed through the valve). The control system may be adapted to be configured in the second valve closing state when there is a requirement to close the valve and a component resides within the valve, such as in a bore of the valve. The component may be any component that it is desired to deploy into a well, which may be selected from the list comprising: tubing, such as coiled tubing, production tubing or tubing forming part of a tool string; wireline or slickline; a downhole tool or tools for performing a function in a well; and parts of any of the foregoing.

The control system may comprise an exhaust control valve which is operable to selectively direct fluid that is vented from the actuator into one of the vent conduit and the vent chamber. The exhaust control valve may be coupled to the actuator. The exhaust control valve may be coupled to the vent conduit. The exhaust control valve may be coupled to the vent chamber. The exhaust control valve may be configurable in a first position in which the fluid exhausted from the actuator is directed into the vent conduit. The exhaust control valve may adopt this configuration in the first valve closing state of the control system. The exhaust control valve may be configurable in a second position in which the fluid exhausted from the actuator is directed into the vent chamber. The exhaust control valve may adopt this configuration in the second valve closing state of the control system.

The vent chamber may be a low pressure chamber, and the valve assembly may comprise a high pressure source of hydraulic fluid for operating the actuator, which may be an accumulator.

The control system may comprise a first actuator control valve for controlling the supply of hydraulic fluid to the actuator for operating the actuator to move the valve member to its open position. The control system may comprise a second actuator control valve for controlling the supply of hydraulic fluid to the actuator for operating the actuator to move the valve member to its closed position. The first and second actuator control valves may be associated with a source of hydraulic fluid and may be associated with a common source of hydraulic fluid. The source may be an accumulator, a hydraulic (e.g. control) line, and/or may comprise an accumulator which is fed by a hydraulic line (e.g. from surface).

The first actuator control valve may be configurable in a first position in which the control valve communicates with the source of hydraulic fluid so that fluid is directed through the control valve to the actuator, to move the valve member to its open position. In the first position, the vent conduit may be isolated. The first actuator control valve may be configurable in a second position in which a part of the actuator that is coupled to the control valve is isolated from the source of hydraulic fluid. In the second position, the actuator may communicate with the vent conduit, so that fluid which is exhausted from the actuator is directed into the vent conduit, when the control system is in its first valve closing state.

The second actuator control valve may be configurable in a first position in which the control valve communicates with the source of hydraulic fluid so that fluid is directed through the control valve to the actuator, to move the valve member to its closed position. In the first position, a vent conduit may be isolated. The second actuator control valve may be configurable in a second position in which a part of the actuator that is coupled to the control valve is isolated from the source of hydraulic fluid. In the second position, the second actuator control valve may communicate with a vent conduit, so that fluid that is exhausted from the actuator is directed into the vent conduit. Separate vent conduits may be provided for the first and second actuator control valves, or the control valves may vent into a common vent conduit.

When the first actuator control valve is in its first position, the second actuator control valve may be in its second position. When the first actuator control valve is in its second position, the second actuator control valve may be in its first position.

The first actuator control valve, and the exhaust control valve, may be provided in a flow path extending to the actuator. When the first actuator control valve is in its first position, the exhaust control valve may be configured in its first position, in which the vent chamber is isolated from the flow path. Fluid flowing from the first actuator control valve to the actuator may then flow through the exhaust control valve to the actuator. When the first actuator control valve is in its second position, the exhaust control valve may be configurable in one of its first and its second positions, so that fluid is selectively directed either to the vent conduit or to the vent chamber, depending upon whether the control system is in its first or second valve closing state.

The second actuator control valve may be provided in a flow path extending to the actuator. When the second actuator control valve is in its first position, fluid may flow from the fluid source to the actuator. When the second actuator control valve is in its second position, fluid that is exhausted from the actuator when the valve member moves to its open position may be directed into a vent conduit that is operatively connectable to the actuator. The vent conduit may be exposed to fluid external to the valve assembly at the prevailing external pressure. Separate vent conduits may be provided for the first and second actuator control valves, or the control valves may vent into a common vent conduit.

The control system may comprise two or more first actuator control valves, which may be arranged in parallel. The control system may comprise two or more second actuator control valves, which may be arranged in parallel. The provision of more than one first and/or more than one second actuator control valve may provide a degree of redundancy. Each of the first and second control valves may be arranged as described above. Arrangement of the control valves in parallel may have the result that operation of either valve in the set of first and/or second actuator control valves may be sufficient for the control system to function.

The hydraulic actuator may comprise a cylinder and a piston mounted for movement within the cylinder, the piston being operatively coupled or connected to the valve member so that movement of the piston serves to move the valve member between its open and closed positions. A first chamber may be defined at a first end of the cylinder, and a second chamber may be defined at a second end of the cylinder. Fluid may be supplied to one of the first and second chambers and exhausted from the other one of the first and second chambers in order to move the piston and so operate the valve. The first end of the cylinder may communicate with one of the vent conduit and the vent chamber when the valve member is closed, depending upon whether the control system is in its first or second valve closing state.

The valve assembly may comprise a controller associated with the control system, the controller being arranged to configure the control system in one of its first and second valve closing states, depending upon the operating requirement. The controller may be configured to select the valve closing state for the control system according to one or more parameters, which may include whether the valve is restricted or obstructed, at a time when the valve member is to be moved to its closed position. If the valve (in particular a bore of the valve) is unobstructed at that time, then the controller may be arranged to configure the control system in its first valve closing state. The operating requirement of the valve may then be to close the valve member without requiring that a cutting operation be performed. Fluid exhausted from the actuator during closing of the valve may then be vented to the exterior through the vent conduit. If the valve (in particular a bore of the valve) is obstructed at that time, then the controller may be arranged to configure the control system in its second valve closing state. The operating requirement of the valve may then be to close the valve member and to perform a cutting operation during closing. Fluid exhausted from the actuator during closing of the valve may then be vented to the vent chamber.

Venting fluid to the exterior of the valve assembly may involve venting the fluid to an exterior of the well tubular through which communication is controlled by the valve assembly. The well tubular may be located within a larger diameter external well tubular, in which case the fluid may be vented to an annular region disposed between the tubulars. In a subsea environment, the well tubular may be located at least partly within a marine riser, and the fluid may be vented into the marine riser. The prevailing external pressure may be the pressure externally of the well tubular. The prevailing external pressure may be the hydrostatic pressure at a particular depth, well pressure, applied pressure (e.g. by pumps at surface), or a combination of one or more of these.

The vent chamber may be a first vent chamber, and the valve assembly may comprise at least one further vent chamber. The control system may have at least one further valve closing state, in which the first vent chamber and the vent conduit may both be isolated from the actuator, and/or in which hydraulic fluid that is exhausted from the actuator during movement of the valve member to its closed position is vented to the second vent chamber. This may provide a degree of redundancy, and/or may facilitate multiple closures of the valve without requiring recovery of the valve assembly.

The valve may be of any suitable type and may be selected from the group comprising a ball type valve, and a sliding gate type valve. A ball type valve may be preferred, which may comprise a ball member that is rotatable between an open position in which a bore of the ball member is aligned with a bore of a housing in which the ball member is mounted, and a closed position in which the bore of the ball member is disposed transverse to the housing bore, thereby closing the valve. The valve member may comprise a cutting feature, which may serve for cutting, severing and/or shearing a component disposed within the valve when the valve member is moved to the closed position. The cutting feature may comprise a cutting edge or surface.

The valve assembly may form part of a valve assembly having a use in the oil and gas exploration and production industry, including but not restricted to an SSTT, an SSSV, a lubricator valve assembly, a retainer valve assembly, and a valve assembly that forms part of a downhole tool. The valve assembly may however have a use in other industries.

In the closed position of the valve member, the valve member may prevent communication along the well tubular. In the open position of the valve member, the valve (in particular a bore of the valve) may be unobstructed. References herein to communication along the well tubular primarily concern fluid communication, but encompasses the passage of components including tubing, wireline and slickline, and downhole tools or parts thereof.

According to a second aspect of the present disclosure, there is provided a control assembly for a valve that is operable to control fluid communication along a well tubular, the valve comprising a valve member which is movable between an open position in which the valve member permits fluid communication along the well tubular and a closed position in which the valve member restricts communication along the well tubular, in which the control assembly comprises a control system, a vent chamber, and a vent conduit. The control system is for selectively controlling the flow of hydraulic fluid to and from a hydraulic actuator of the valve, and for moving the valve member between its open and closed positions to operate the valve. The vent chamber is operatively connectable to the hydraulic actuator, for selectively receiving hydraulic fluid that is exhausted from the actuator when the valve member is moved to its closed position. The vent conduit is operatively connectable to the hydraulic actuator, for selectively receiving hydraulic fluid that is exhausted from the actuator when the valve member is moved to its closed position, and the vent conduit is adapted to be exposed to fluid external to the valve assembly at the prevailing external pressure. The control assembly has a first valve closing state in which the vent chamber is isolated from the hydraulic actuator and hydraulic fluid that is exhausted from the actuator during movement of the valve member to its closed position is vented to an exterior of the valve assembly through the vent conduit. The control assembly has a second valve closing state in which hydraulic fluid that is exhausted from the hydraulic actuator during movement of the valve member to its closed position is vented into the vent chamber. The control assembly is configurable in a selected one of the first and second valve closing states according to an operating requirement of the valve.

Further features of the control assembly of the second aspect may be derived from the text set out elsewhere in this document, particularly in or with reference to the valve assembly of the first aspect, at least in so far as common parts of the control and valve assemblies are referred to.

According to a third aspect of the present disclosure, there is provided a method of operating the valve assembly of the first aspect of the present disclosure to control fluid communication along a well tubular, the method comprising the steps of: operating the valve assembly with its valve member in the open position, to permit fluid communication along the well tubular; and on detecting a requirement to close the valve, actuating the valve member to its closed position in which the valve member restricts fluid communication along the well tubular. The step of actuating the valve member to its closed position comprises assessing an operating requirement of the valve, and: a) on determining a requirement to close the valve without performing a cutting operation, configuring the control system in its first valve closing state so that fluid that is exhausted from the actuator during movement of the valve member to its closed position is vented to an exterior of the valve assembly through the vent conduit; or b) on determining a requirement to close the valve and to perform a cutting operation, configuring the control system in its second valve closing state so that fluid that is exhausted from the actuator during movement of the valve member to its closed position is vented into the vent chamber.

Assessing the operating requirement of the valve may comprise determining whether a component is located through the valve, which component requires to be cut during closing of the valve.

Further features of the method of the third aspect may be derived from the text set out elsewhere in this document, particularly in or with reference to the valve assembly of the first aspect.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
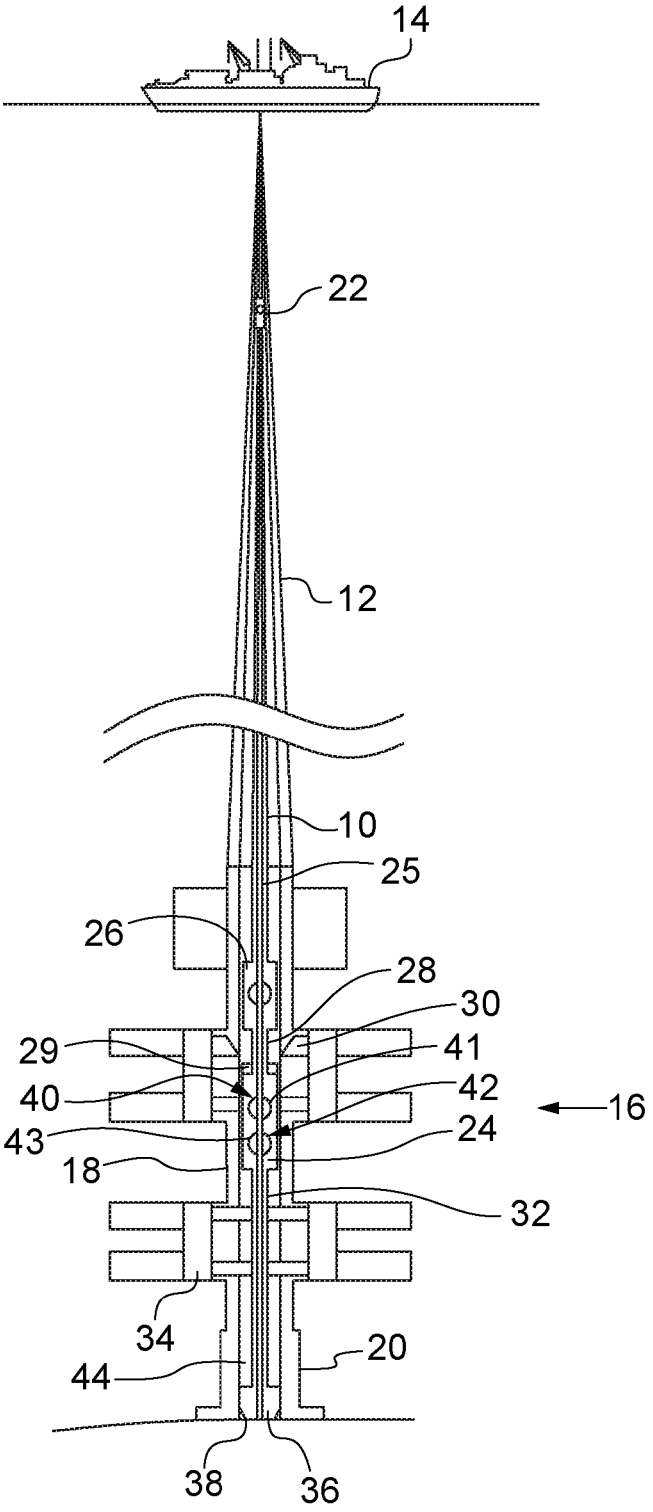
FIG. 1 is a schematic side view of a landing string of a conventional type, incorporating a subsea test tree (SSTT), shown during an intervention procedure, in which the assembly is located in a blowout preventer (BOP) mounted on a wellhead.

Turning firstly to FIG. 1, there is shown a schematic view of a landing string assembly 10 of a conventional type, shown in use within a riser 12 and extending between a surface vessel 14 and a subsea wellhead assembly 16, which includes a BOP 18 mounted on a wellhead 20 of a well. The use and functionality of landing strings are well known in the industry for through-riser deployment of equipment, such as completion architecture, well testing equipment, intervention tools and the like, into a subsea well from a surface vessel. The landing string 10 assembly forms a well tubular through which fluid, tubing and other such components can pass into and out of the well.

When in a deployed configuration the landing string 10 extends through the riser 12 and into the BOP 18. While deployed the landing string 10 provides many functions, including permitting the safe deployment of wireline or coiled tubing equipment (not shown) through the landing string and into the well, providing the necessary primary well control barriers and permitting emergency disconnect while isolating both the well and landing string 10. Wireline or coiled tubing deployment may be facilitated via a lubricator valve 22 which is located proximate the surface vessel 14.

Well control and isolation is provided by a suite of valves, which are located at a lower end of the landing string 10 inside the BOP. The valve suite includes a lower valve assembly in the form of a subsea test tree (SSTT) 24 which provides a safety barrier to contain well pressure, and also functions to cut any wireline or coiled tubing 25 which extends through the landing string 10. The valve suite can also include an upper valve assembly, typically referred to as a retainer valve 26, which isolates the landing string contents and which can be used to vent trapped pressure from between the retainer valve 26 and SSTT 24. A shear sub component 28 extends between the retainer valve 26 and SSTT 24, which is capable of being sheared by shear rams 30 of the BOP 18 if required. A latch 29 connects the landing string 10 to the SSTT 24 at the shear sub 28. A slick joint 32 extends below the SSTT 24 which facilitates engagement with BOP pipe (seal) rams 34.

The landing string 10 includes a tubing hanger 36 at its lowermost end, which engages with a corresponding tubing hanger 38 provided in the wellhead 20. When the landing string 10 is fully deployed and the corresponding tubing hangers 36 and 38 are engaged, the weight of the lower string (such as a completion, workover string or the like which extends into the well and thus is not illustrated) becomes supported through the wellhead 20.

It is desirable to employ the SSTT 24 to control communication along the landing string 10, and so to provide pressure control. During normal operation (in a non-emergency situation), this is achieved by operating ball valves 40 and 42 of the SSTT 24 to move them from open to closed positions. This is achieved by firstly withdrawing the wireline or coiled tubing 25 (and any equipment coupled to it) from the well to a position uphole of the SSTT valves 40 and 42, and then actuating the valves to move to their closed positions.

In an ESD procedure however, there may be insufficient time to recover the wireline or coiled tubing 25, which means that a procedure to close the SSTT 24 must be commenced at a time when the wireline or coiled tubing resides within the bores of rotatable members 41 and 43 of the valves 40 and 42. To facilitate this, and in a known fashion, the upper valve 40 has a cutting function, its valve member 41 comprising a cutting feature such as a cutting edge or surface which can sever the wireline or coiled tubing 25 when the valve is actuated. The portion of wireline or coiled tubing 25 below the cut is dropped into the well, and can be retrieved in a fishing procedure when the well is reopened. The lower valve 42 has a sealing function, and serves to seal the bore of the SSTT 24 when it is actuated to its closed position. Operation of the two valves 40 and 42 is sequenced so that the lower valve 42 is only actuated after the upper valve 40 has been actuated to sever the wireline or coiled tubing 25, so that the bore of the lower valve member 43 is not blocked by the wireline/tubing. Following closure of the SSTT valves 40 and 42, the landing string 10 may be released by releasing the latch 29, and the string recovered to surface. The BOP seal rams 34 are also operated to seal the annular region 44 surrounding the SSTT 24, by engaging the slick joint 32.

In an EQD procedure, the steps that are taken correspond to those for an ESD, save that the BOP shear rams 30 are operated prior to release of the landing string 10 from the SSTT 24. This severs the landing string 10 at the shear sub 28 to shut-in the well. Operation of the BOP shear rams 30 is sequenced to follow after operation of the SSTT valves 40 and 42, as described above.

Whilst severing of the wireline or coiled tubing 25 will typically occur during an ESD or EQD, it may be necessary or desirable to sever the wireline/tubing in other procedures, including during what might otherwise be considered to be 'normal' operation. In simple terms, severing of the wireline or coiled tubing 25 may be required in a situation in which there is a short time requirement to close the SSTT valves 40 and 42, and insufficient time to pump fluid from surface to operate the valves.

Figure 2:
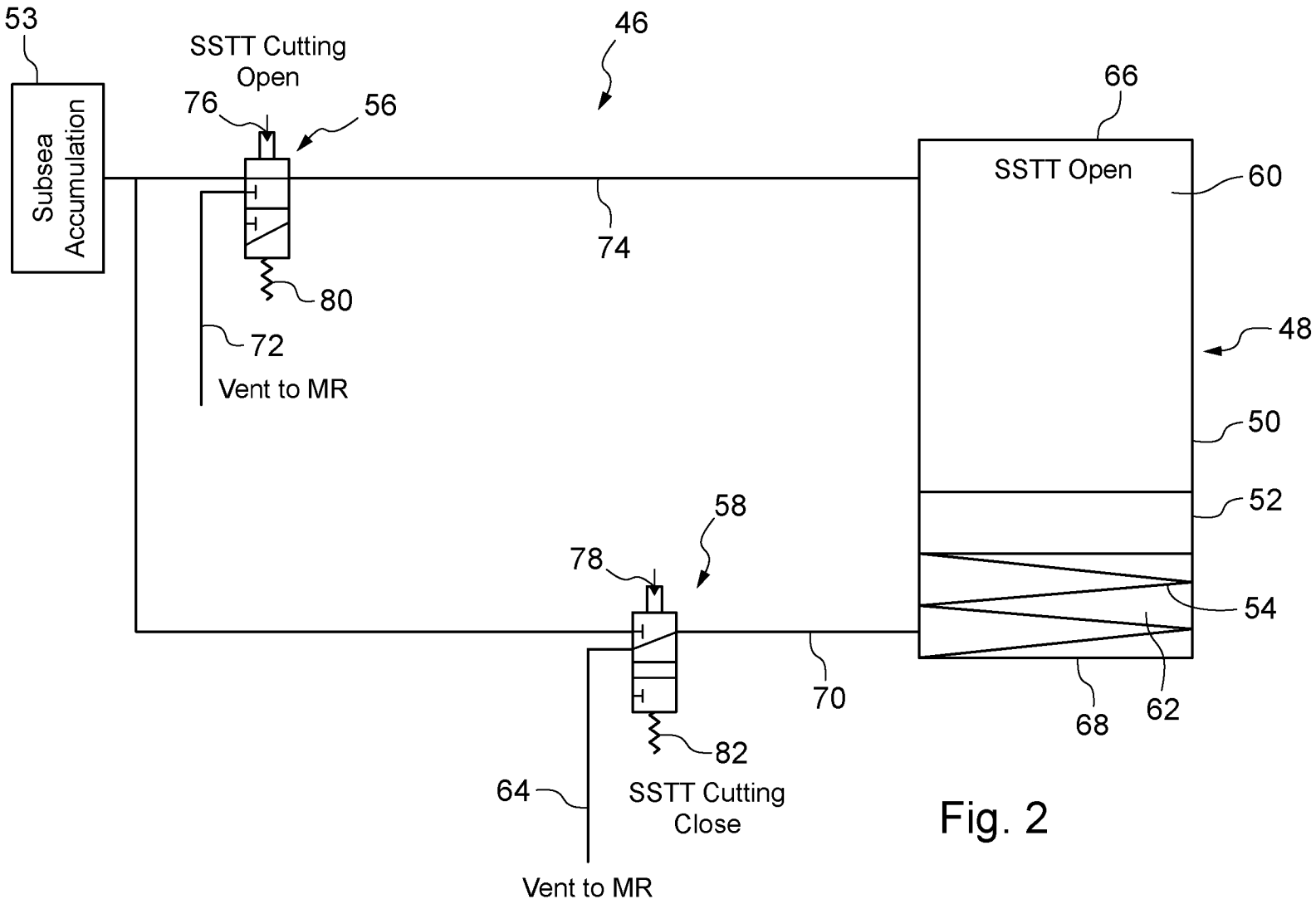
FIG. 2 is a schematic illustration of a hydraulic circuit associated with an upper, cutting valve of the SSTT shown in FIG. 1.

Turning now to FIG. 2, there is shown a schematic illustration of a hydraulic circuit associated with the upper, cutting ball valve 40 of the SSTT 24 shown in FIG. 1 and described above. A control system 46 is shown, which controls the flow of hydraulic fluid to and from a hydraulic actuator 48 which operates the valve 40. The hydraulic actuator 48 comprises a cylinder 50 and a piston 52 which is mounted for movement within the cylinder 50 under applied fluid pressure. Hydraulic fluid is supplied from a source 53 (which takes the form of a subsea accumulator) to the actuator 48, to control movement of the piston 52. Typically, the accumulator is charged with hydraulic fluid at high pressure, and may be fed by a hydraulic line (not shown) extending to surface. The piston 52 is coupled to the rotatable member 41 of the upper valve 40, and controls movement of the valve member between its open and closed positions. The piston 52 is shown in FIG. 2 in a position that it adopts when the valve member 41 is in an open position, in which a bore of the valve member is substantially aligned with a bore of the SSTT 24. A biasing element in the form of a compression spring 54 acts upon the piston 52 to urge it towards a position in which the valve member 41 is closed, so that the upper valve 40 failsafe closes in the event of loss of hydraulic pressure.

The control system 46 comprises a first actuator control valve 56 and a second actuator control valve 58, which together serve to control the flow of hydraulic fluid to and from the actuator 48 to operate the valve 40. The control valves 56 and 58 are each moveable between respective first and second positions, the first control valve 56 being shown in FIG. 2 in its first position, in which hydraulic fluid can be supplied from the subsea accumulator 53 into the actuator 48, specifically into a first chamber 60 of the actuator. The second control valve 58 is shown in its second position, in which a second chamber 62 of the actuator 48 communicates with a vent line 64. In the second position of the second control valve 58, the second actuator chamber 62 is isolated from the accumulator 53, and a vent line associated with the first control valve 56 is isolated.

The supply of hydraulic fluid into the first actuator chamber 60 serves to translate the piston 52 in a direction away from a first end 66 of the actuator cylinder 50 and towards a second end 68, hydraulic fluid in the second actuator chamber 62 then being exhausted through a hydraulic line 70 and into the vent conduit 64. The position of the piston 52 shown in FIG. 2 corresponds to the open position of the valve member 41 of the upper valve 40.

Operation of the control system 46 to close the upper valve 40 is achieved by actuating the first control valve 56 to its second position, in which the first actuator chamber 60 communicates with a vent conduit 72 via a hydraulic line 74. The first control valve 56 then adopts a similar position to the second control valve 58 which is shown in FIG. 2. Accordingly, the first actuator chamber 60 is then isolated from the accumulator 53. At the same time, the second actuator valve 58 is moved from its second position shown in FIG. 2 to its first position, in which the second actuator chamber 62 communicates with the accumulator 53. In its second position, the second control valve 58 adopts a similar position as the first control valve 56 shown in FIG. 2. This movement of the second control valve 58 to its first position isolates the vent conduit 64. Hydraulic fluid is then supplied to the second actuator chamber 62 from the accumulator 53, which acts to urge the actuator piston 52 away from the second end 68 of the cylinder 50 and towards the first end 66. Hydraulic fluid in the first cylinder chamber 60 is then exhausted into the vent conduit 72. This movement of the piston 52 acts to move the valve member 41 of the upper SSTT valve 40 from its open position towards its closed position, severing any component (such as the coiled tubing 25) residing in the bore of the valve member.

The first and second actuator control valves 56 and 58 are typically provided as directional control valves (DCVs), which may be piloted between their different positions under a pilot pressure applied to respective pilot ports 76 and 78, and which may be biased towards their respective second positions by biasing elements such as respective compression springs 80 and 82.

Both of the vent conduits 64 and 72, but in particular the vent conduit 72 associated with the first actuator control valve 56, are exposed to fluid external to the valve assembly, which is at the prevailing external pressure. In the case of the SSTT 24 shown in FIG. 1, this would be the pressure of fluid contained in the annular region 44 surrounding the SSTT, which communicates with the interior of the marine riser 12. As will be understood by persons skilled in the art, the fluid in the annular region 44 is at a relatively high pressure, which is typically the hydrostatic pressure found at the particular depth that the SSTT has been deployed to, and which may in fact be greater depending upon the well pressure and any pressure applied from surface, for example by pumps.

Accordingly, during closing of the valve 40, the hydraulic fluid in the first actuator chamber 60 effectively experiences the relatively high pressure that is found externally of the valve assembly, in the annular region 44. This has the result that operation of the actuator 48, to move the valve member 41 of the upper valve 40 from its open position to its closed position, requires that the actuator piston 52 act against this high reference pressure in order to translate towards the first end 66 of the cylinder 50. This means that the hydraulic fluid in the second cylinder chamber 62 must be exposed to a pressure which is higher than the pressure of the external fluid in the annulus 44, in order to move the piston 52 and so the valve member 41.

In normal operation, a small pressure differential between the fluid in the second actuator chamber 62 and that in the first actuator chamber 60 may be sufficient to translate the piston 52, and so to rotate the valve member 41 of the upper valve 40 to its closed position (assisted by the compression spring 54). However, in the event for example of an ESD or an EQD, where the coiled tubing 25 (or other component) resides within the valve 40 bore, the valve member 41 of the upper valve 40 is required to sever the coiled tubing during its movement to the closed position. This requires that a significant pressure force be imparted upon the actuator piston 52 in order to translate it and so rotate the valve member 41 to cut the coiled tubing 25. This means that a very high pressure must be applied to the fluid in the second actuator chamber 62 by the accumulator 53, in order to overcome the high reference pressure in the annular region 44. This requires a very high accumulator pressure, with the disadvantages discussed in detail in the introduction, particularly in the context of operation of the second, sealing ball valve 42 of the SSTT 24.

Figure 3:
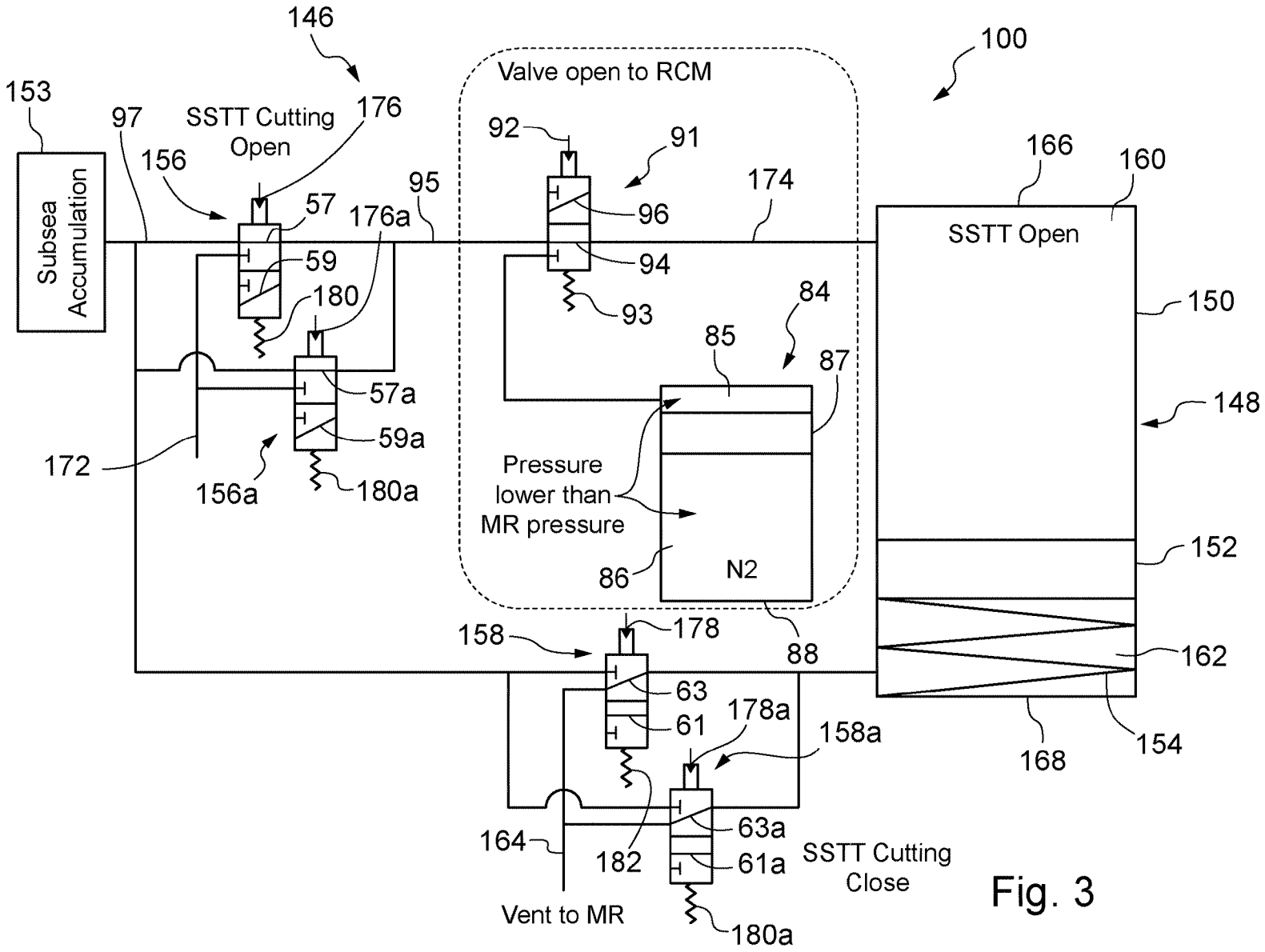
FIG. 3 is a schematic illustration of a hydraulic circuit of a valve assembly for controlling fluid communication along a well tubular, in accordance with an embodiment of the present invention, the valve assembly having a use in the SSTT shown in FIG. 1 and being shown with a valve of the assembly in an open position.

Turning now to FIG. 3, there is shown a schematic hydraulic circuit diagram of a valve assembly for controlling fluid communication along a well tubular in accordance with an embodiment of the present invention. The valve assembly is indicated generally in the drawing by reference numeral 100. Like components of the valve assembly 100 with that shown in FIG. 2 and described above share the same reference numerals, incremented by 100. The valve assembly 100 has a use in numerous different valves, but will be described in relation to the SSTT 24 shown in FIG. 1 and described above, specifically in controlling operation of the upper (cutting) valve 40.

The valve assembly 100 generally comprises a hydraulically operated valve which, in the illustrated embodiment, is the upper (cutting) valve 40 of the SSTT 24. The valve 40 comprises valve member 41, which is moveable between an open position in which the valve member permits communication along a well tubular, and a closed position in which the valve member restricts communication along the well tubular. In the illustrated embodiment, the well tubular is the landing string 10 shown in FIG. 1. The valve 40 also comprises a hydraulic actuator 148 associated with the valve member 41, for moving the valve member between its open and closed positions. Once again, the valve 40 typically takes the form of a ball-type valve comprising a ball member 41, and suitably includes a cutting feature for severing the coiled tubing 25 extending through the valve bore.

The valve assembly 100 also comprises a control system 146 for selectively controlling the flow of hydraulic fluid to and from the hydraulic actuator 148, to operate the valve 40, and a vent chamber provided by an accumulator 84 which is operatively connectable to the hydraulic actuator 148, for selectively receiving hydraulic fluid that is exhausted from the actuator when the valve member 41 is moved to its closed position. A vent conduit 172 is also operatively connectable to the hydraulic actuator 148, for selectively receiving hydraulic fluid that is exhausted from the actuator when the valve member 41 is moved to its closed position. The vent conduit 172 is exposed to fluid external to the valve assembly 100 at the prevailing external pressure, suitably being exposed to the fluid in the annular region 44 and so to the interior of the marine riser 12.

The control system 146 has a first valve closing state in which the accumulator 84 is isolated from the hydraulic actuator 148, and hydraulic fluid that is exhausted from the actuator during movement of the valve member 41 to its closed position is vented to the exterior of the valve assembly through the vent conduit 172. The control system 146 also has a second valve closing state in which hydraulic fluid that is exhausted from the actuator 148 during movement of the valve member 41 to its closed position is vented into the accumulator 84. The control system 146 is configurable in a selected one of the first and second valve closing states according to an operating requirement of the valve 40. This will be described in further detail below.

The provision of a valve assembly 100 having such first and second valve closing states may have the advantage that hydraulic fluid which is vented from the valve actuator 148 during movement of the valve member 41 to the closed position can selectively be directed into one of the vent conduit 172 and the accumulator 84. Venting the fluid to the exterior 44 of the valve assembly through the vent conduit may be sufficient for 'normal' operation of the valve, in which there is no requirement to cut a tubing or other component extending through a bore of the valve 40. Such operation of the valve 40 may not require a large pressure differential to exist between the hydraulic actuator 148 and the prevailing external reference pressure (which can be relatively high) in order to close the valve. Venting the fluid to the accumulator 84 may be arranged when there exists a requirement to cut tubing or other components extending through the valve 40. Such operation of the valve 40 may require a large pressure differential to exist between the hydraulic actuator 148 and a reference pressure in the accumulator 84, in order to close the valve. This can be facilitated by charging the accumulator 84 with a reference pressure fluid (e.g. a gas such as Nitrogen) which is at a much lower pressure than the prevailing external (reference) pressure.

FIG. 3 shows the valve assembly 100 at a time when the valve 40 is open, the valve member 41 being disposed as shown in FIG. 1, so that its bore is substantially aligned with the bore of the SSTT 24. Coiled tubing 25 has been deployed through the SSTT 24 and into a wellbore of the well. The valve 40 has been moved to its open position, and the valve member 41 held in its open position, by supplying hydraulic fluid from an accumulator 153 into a first chamber 160 of a cylinder 150 of the actuator 148, and exhausting hydraulic fluid from a second chamber 162 and into a vent conduit 164. In a similar fashion to that described above, this has translated a piston 152 of the actuator 148 towards a second end 168 of the cylinder, carrying the valve member 41 to its open position.

Figure 4:
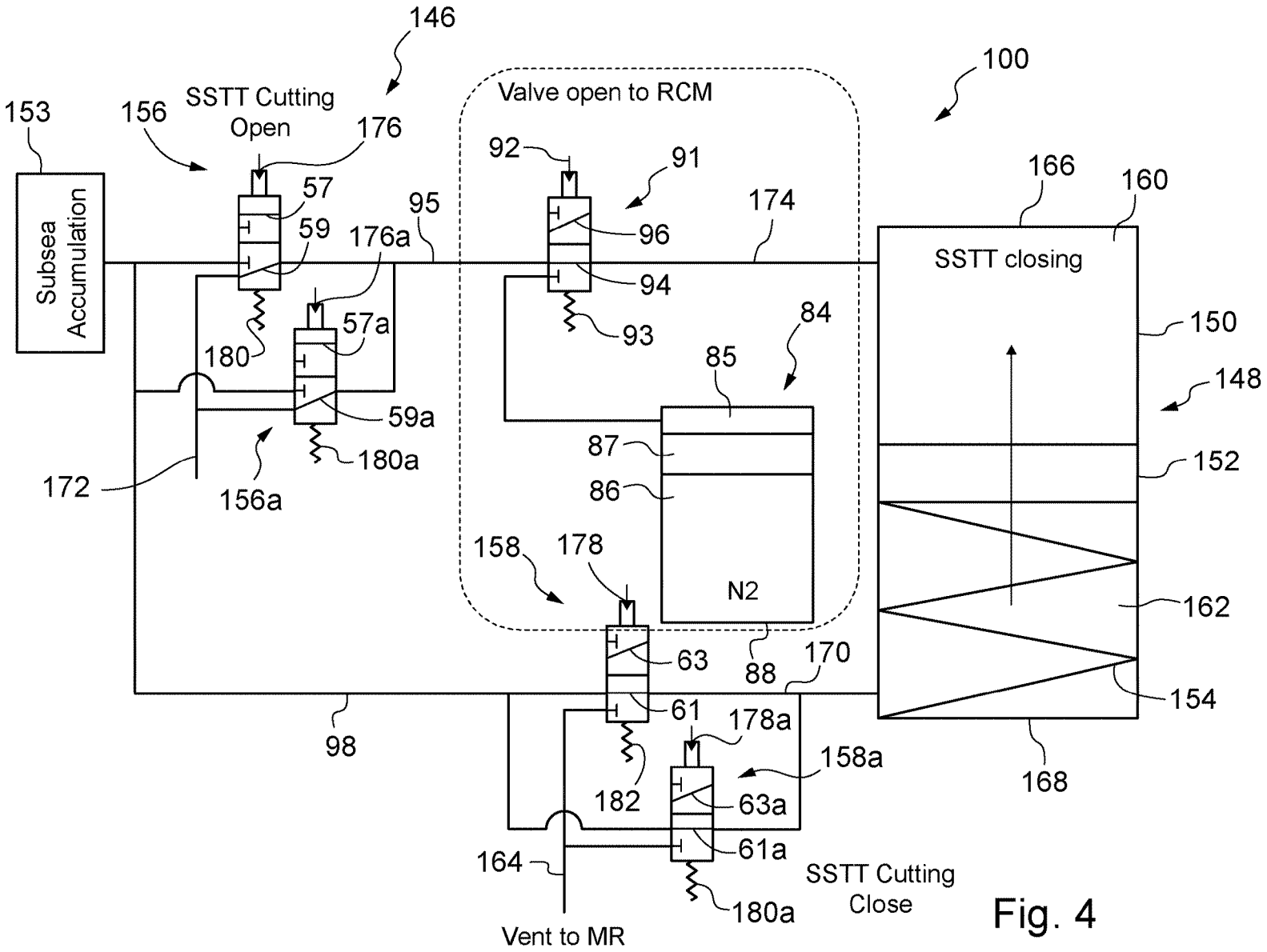
FIGS. 4 and 5 are views similar to FIG. 3, but which show the valve assembly during a closing operation, FIG. 4 illustrating the valve assembly during a normal operation when the valve is unobstructed and there is no requirement to cut a component, and FIG. 5 showing an ESD or EQD in which a component resides within the valve and requires to be severed during movement of the valve to a closed position.
Figure 5:
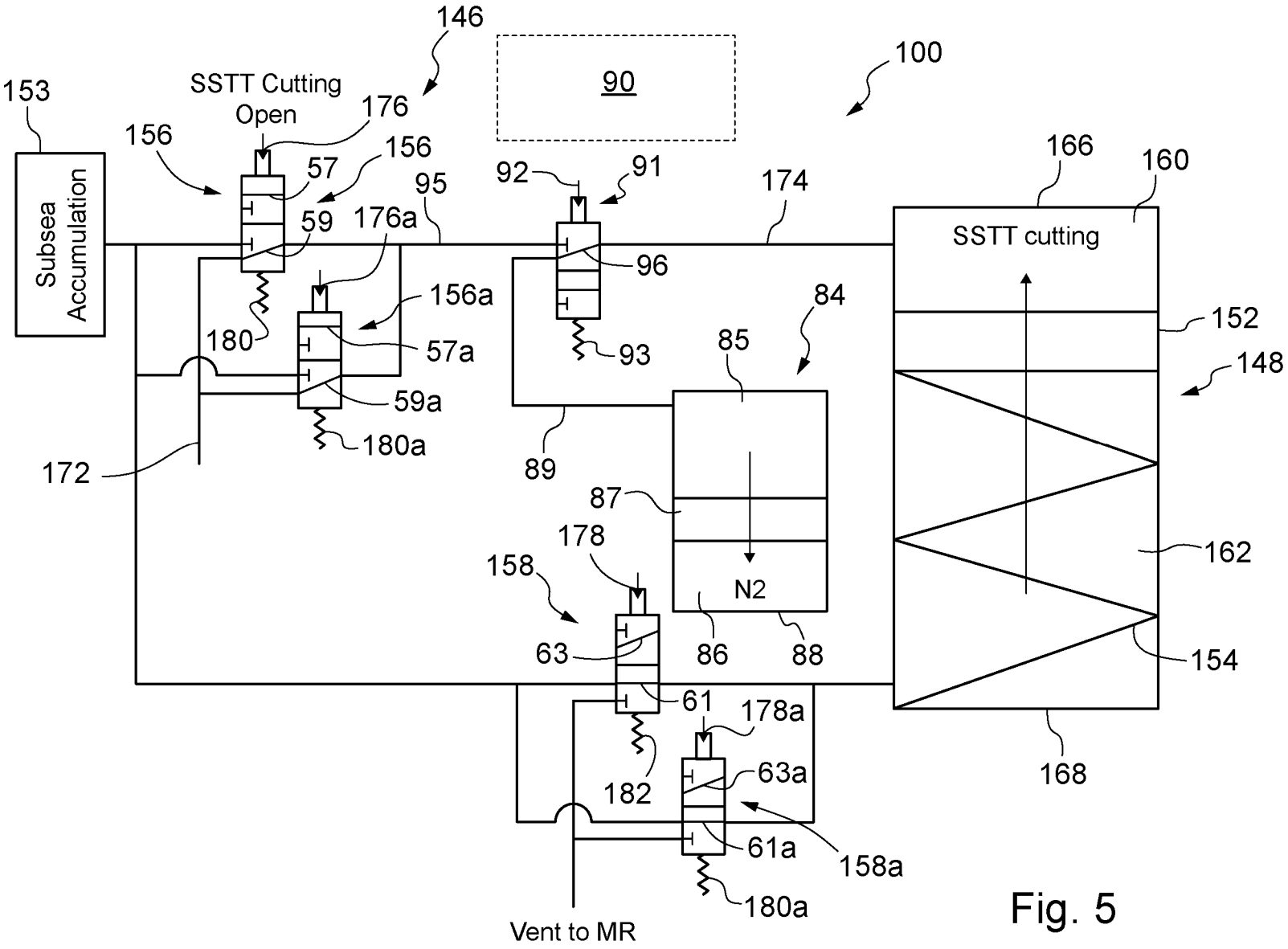

FIGS. 4 and 5 are views similar to FIG. 3, but which show the valve assembly 100 during a closing operation. FIG. 4 illustrates the valve assembly 100 during a normal operation when the valve 40 is unobstructed, and so there is no requirement to cut coiled tubing 25 or other components residing within the SSTT 24. FIG. 5 in contrast shows an ESD or EQD situation, in which coiled tubing 25 or other components reside within the valve 40, and so require to be severed during movement of the valve member 41 of the valve 40 to its closed position. As will be described below, FIG. 4 corresponds to a situation in which the control system 146 is in its first valve closing state, whereas FIG. 5 corresponds to a situation in which the control system 146 is in its second valve closing state.

As mentioned above, FIG. 4 shows the valve assembly 100 in a situation in which the valve 40 of the SSTT 24 is to be closed, during normal operation. This might for example be where a pressure test is to be conducted in a non-emergency situation, and which involves closing both the SSTT valves 40 and 42. Other scenarios in which a normal closing operation may be performed can be envisaged.

In this example, the bore of the valve member 41 of the upper valve 40 is unobstructed by the coiled tubing 25 or indeed any other component, which means that the valve member 41 can be moved from its open to its closed position without having to sever coiled tubing or some other component. Accordingly and as described above, it is only necessary for a relatively small pressure differential to be provided (e.g. above 0 psig), a biasing element in the form of a compression spring 154 assisting movement of the piston 152, and so movement of the valve member 41 from its open to its closed position.

The control system 146 has detected the operating requirement for the valve 40, namely for the valve member 41 to move to its closed position without requiring a cutting operation to be performed. The control system 146 is then configured appropriately. This involves the control system 146 being arranged in its first valve closing state in which the accumulator 84 is isolated from the hydraulic actuator 148, and hydraulic fluid that is exhausted from the actuator during movement of the valve member to its closed position (controlled by the actuator piston 152) is vented to the exterior of the valve assembly 100, into the annular region 44, through the vent conduit 172. The actuator piston 152 is actuated to move away from the second end 168 of the actuator cylinder 150 towards the first end 166 by supplying hydraulic fluid from the accumulator 153 into the second cylinder chamber 162, and exhausting hydraulic fluid from the first cylinder chamber 160 and to the vent conduit 172. FIG. 4 shows the actuator piston 152 part way through its movement towards the first cylinder end 166, in which the valve member 41 is part way between its open and closed positions.

FIG. 5 shows the valve assembly 100 during an ESD or EQD (or other applicable state). At this time, and as discussed above, a component such as the coiled tubing 25 resides within the bore of the valve member 41 of the upper valve 40, and requires to be severed during movement of the valve member to its closed position. The control system 146 therefore detects an operating requirement for the valve 40 as being to sever the coiled tubing 25 during closure. The control system 146 is then configured in the second valve closing state, in which hydraulic fluid that is exhausted from the actuator 148 during movement of the valve member 41 to its closed position is vented into the accumulator 84. At this time, the vent conduit 172 is isolated from the actuator 148, so that all of the fluid which is exhausted from the actuator is vented into the accumulator 84. This provides the advantage that the reference pressure that the fluid in the first cylinder chamber 160 is exposed to is the much lower pressure of fluid in the accumulator 84, which might be surface atmospheric pressure. Accordingly, it is not necessary for the actuator piston 152 to overcome a high external pressure, which might be in the region of perhaps 4000 to 8000 psig.

As a consequence, the hydraulic fluid in the accumulator 153 can be pressurized to a lower operating pressure, as it does not need to overcome a high prevailing external reference pressure of the fluid external to the valve assembly 100, in the annular region 44. A high pressure differential can then be created between fluid in the second actuator chamber 162 and the fluid in the first actuator chamber 160 (which references the lower pressure in the accumulator 84), in order for the piston 152 to move away from the second end 168 of the cylinder towards the first end 166, thereby moving the valve member 41 towards its closed position and severing the coiled tubing 25 or other component that is located in the bore of the valve member. This in turn provides the advantage that the accumulator 153, charged with hydraulic fluid at a lower pressure than in a conventional valve assembly of the type shown in FIG. 2 and described above, can also be used to actuate the lower, sealing valve 42 of the SSTT 24, balancing the high pressure—low volume requirement of the upper valve 40, with the lower pressure—high volume requirement of the lower valve 42.

The valve assembly 100 will now be described in more detail, with reference again to FIGS. 1 and 3 to 5.

The accumulator 84 comprises a first chamber 85 for receiving hydraulic fluid that is exhausted from the actuator 148, a second chamber 86 containing a compressible fluid, and an isolating member 87 which separates the second chamber from the first chamber. Typically, the accumulator 84 comprises a cylinder 88 and the isolating member 87 takes the form of a piston which is moveable within the cylinder for transmitting the pressure of the fluid in the first chamber 85 to the fluid in the second chamber 86. The compressible fluid in the second chamber 86 will typically be a gas, and may be an inert gas such as Nitrogen. The compressible fluid will normally be charged into the accumulator chamber 86 at surface, for example at surface atmospheric pressure. This provides a low reference pressure against which the actuator piston 152 can operate when the control system 146 is in its second closing state.

In the second valve closing state shown in FIG. 5, hydraulic fluid that is exhausted from the first chamber 160 of the hydraulic actuator 148, during movement of the valve member 41 to its closed position, is vented into the first chamber 85 of the accumulator 84, through a branch conduit 89 which communicates with a hydraulic line 174 extending from the actuator 148. The first accumulator chamber 85, and the branch conduit 89, is typically initially charged with hydraulic fluid which is at the same pressure as the compressible gas in the second accumulator chamber 86. In this way, the first chamber 85 and branch conduit 89 similarly provide a lower reference pressure against which the actuator piston 152 can act when the control system 146 is in its second valve closing state, and the accumulator piston 87 is pressure balanced.

The control system 146 is configurable in the selected valve closing state in response to a control command issued to the control system. The control command may be issued from surface. However, the valve assembly 100 will typically comprise a controller, indicated in broken outline by reference numeral 90 in FIG. 5, which issues the control command to the control system 146. Issue of the control command may be automated, on the controller 90 detecting a need to close the valve 40. The controller 90 is arranged to configure the control system 146 in its first valve closing state when it detects a requirement to close the valve 40, and when it detects that the valve is unrestricted or unobstructed, in particular when the bore of the valve member 41 is unrestricted or unobstructed by the coiled tubing 25 or other component. It will be understood that this can be achieved using suitable sensors (not shown) and control circuitry of the controller 90, optionally with input from the surface.

Similarly, the controller 90 is arranged to configure the control system 146 in its second valve closing state when it detects a requirement to close the valve 40 and a component such as the coiled tubing 25 resides within the valve 40, specifically in the bore of the valve member 41. The controller 90 thus actively monitors operating parameters including whether coiled tubing or other components are deployed through the valve 40 (and so through the SSTT 24), and may also monitor other parameters including fluid pressure and flow within the landing string 10 and the annular region 44.

The control system 146 comprises an exhaust control valve 91, which takes the form of a DCV. The DCV 91 is of a conventional type and is moveable between a first position shown in FIGS. 3 and 4, and a second position shown in FIG. 5. The exhaust valve 91 is moveable from its first position to its second position by the application of fluid pressure to a pilot port 92 of the valve, moving a shuttle of the valve against a biasing element in the form of a compression spring 93.

As described above, FIG. 3 shows the valve assembly 100 at a time when the valve 40 is open, hydraulic fluid having been supplied into the first actuator chamber 160 from the accumulator 153. At this time, the exhaust valve 91 is held in its first position, by bleeding pressure off from the port 92 so that the compression spring 93 urges the valve shuttle to its first position. The exhaust valve 91 is held in this first position when the control system 146 is in its first closing state shown in FIG. 4, when fluid that is exhausted from the first actuator chamber 160 is to be directed into the vent conduit 172 and vented to the annular region 44. Again this is achieved by bleeding off pressure applied to the valve port 92 so that the spring 93 holds it in the first position. In its first position, a communication path 94 within the valve couples the hydraulic line 174 with a hydraulic line 95, to direct exhausted fluid into the vent conduit 172.

When the controller 90 detects a requirement to close the valve 40 and to cut the coiled tubing 25 or other component, the controller actuates the exhaust valve 91 to move it to the second position. This is achieved by supplying pilot fluid to the valve port 92, to overcome the spring 93 force and translate the valve shuttle to its second position, in which a communication path 96 of the valve connects the hydraulic line 174 with the branch conduit 89 extending to the accumulator 84. Hydraulic fluid that is exhausted from the first actuator chamber 160 is then directed from the hydraulic line 174 into the branch conduit 89, and so into the first accumulator chamber 85. At this time, the hydraulic line 95 is isolated from the actuator 148, so that the actuator is isolated from the vent conduit 172. This has the effect that the actuator piston 152 references the much lower pressure of the compressible fluid in the second actuator chamber 86, rather than the much higher prevailing external pressure in the annular region 44, which the vent conduit 172 is exposed to.

The control system 146 also comprises a first actuator control valve 156 and a second actuator control valve 158, which operate together to control the supply of hydraulic fluid from the accumulator 153 to the actuator 148, for operating the actuator to move the valve member 41 between its open and closed positions. In the illustrated embodiment, the control system 146 includes two first actuator control valves 156 and 156*a*, and two second actuator control valves 158 and 158*a*, each of which are arranged in parallel. This provides a degree of redundancy, operation of either valve 156/156*a* and 158/158*a* in the set of first and second actuator control valves being sufficient for the control system 146 to function. The first actuator control valves 156 and 156*a* are of similar structure and operation, and the second actuator control valves 158 and 158*a* of similar construction and operation. Like components of the first valve 156*a* with the valve 156, and of the second valve 158*a* with the valve 158, share the same reference numerals with the addition of the suffixes 'a'. Only the operation of the first actuator control valve 156 and the second actuator control valve 158 will be described in detail in this document. It will be understood however that both of the respective first and second actuator control valves are operated in a similar way, and in parallel.

The first actuator control valve 156 controls the supply of hydraulic fluid from the accumulator 153 to the first actuator chamber 160, to move the valve member 41 to its open position. This is shown in FIG. 3. The first actuator control valve 156 again takes the form of a DCV, and is configurable in a first position in which it communicates with the accumulator 153 so that hydraulic fluid is directed through the control valve to the actuator 148, to move the valve member 41 to its open position. Movement of the first control valve 156 to its first position is achieved by applying pilot pressure to a port 176, translating a shuttle of the valve against the biasing force of a spring 180. A communication path 57 in the valve 156 then brings a hydraulic line 97 extending from the accumulator 153 into communication with the hydraulic line 95, which communicates with the first actuator chamber 160 through the exhaust control valve 91 and the hydraulic line 174. At this time, the vent conduit 172 is isolated.

The first actuator control valve 156 is also configurable in a second position in which the first actuator chamber 160 is isolated from the accumulator 153, and communicates with the vent conduit 172. This is achieved by bleeding off pilot pressure from the pilot port 176, so that the biasing spring 180 urges the valve shuttle to its second position, in which the hydraulic line 95 communicates with the vent conduit 172 through a communication path 59 in the valve 156. In the first valve closing state of the control system 146, hydraulic fluid that is exhausted from the first actuator chamber 160 is then directed into the vent conduit 172, through the hydraulic lines 174 and 95.

The second actuator control valve 158 is similarly configurable in a first position in which it opens communication between the accumulator 153 and the second actuator chamber 162, so that fluid is directed through the control valve to the actuator 148, to move the valve member 41 to its closed position. This is shown in both FIGS. 4 and 5. The second actuator control valve 158 is again provided as a DCV, and adopts its first position when pilot pressure is bled off from a pilot port 178, so that a biasing spring 82 translates a shuttle of the valve to the first position in which a communication path 61 connects a hydraulic line 98 extending from the accumulator 153 with a hydraulic line 170 connected to the actuator 148. At this time, a vent conduit 164 is isolated.

The second actuator control valve 158 is moved to its second position by the application of pilot pressure to the port 178, translating the valve shuttle against the force of the biasing spring 182 and to the position shown in FIG. 3. The hydraulic line 170 then communicates with the vent conduit 164 through a communication path 63 in the valve, so that fluid which is exhausted from the second actuator chamber 162 during movement of the valve member 41 to its open position is vented to the exterior of the valve assembly 100 (into the annular region 44) via the vent conduit 164.

The first actuator control valve 156 and the exhaust control valve 91 are provided in a flow path extending to the actuator 148. When the first actuator control valve 156 is in its first position of FIG. 3, the exhaust control valve 91 is similarly in its first position (also shown in FIG. 3), so that the accumulator 84 is isolated from the flow path. Fluid flowing from the accumulator 153 through the first actuator control valve 156 then flows through the exhaust control valve 91 to the actuator 148, specifically into its first chamber 160.

When the first actuator control valve 156 is in its second position of FIGS. 4 and 5, the exhaust control valve 91 is configurable in either its first position of FIG. 4, or its second position of FIG. 5, so that fluid which is exhausted from the actuator 148 during movement of the valve member 41 to its closed position is selectively directed either into the vent conduit 172 (FIG. 4), or into the accumulator 84 (FIG. 5), depending upon whether the control system 146 is in its first or second valve closing state.

The second actuator control valve 158 is also provided in a flow path extending to the actuator 148. When the second actuator control valve 158 is in its first position of FIGS. 4 and 5, fluid may flow from the accumulator 153 to the actuator 148, to move the valve member 41 to its closed position. When the second actuator control valve is in its second position of FIG. 3, fluid that is exhausted from the actuator 148 when the valve member 41 moves to its open position is directed into the vent conduit 164, which communicates with the annular region 44 and so is exposed to fluid external to the valve assembly 100 at the prevailing external pressure.

The vent conduits 172 and 164 may provide separate vent paths to the exterior of the valve assembly 100, or may be connected so as to provide a common vent. Since opening of the valve 40 does not require its valve member 41 to sever coiled tubing or any other component, a relatively small pressure differential between fluid in the first actuator chamber 160 and the second chamber 162 may be sufficient to overcome the spring 154 force and so translate the piston 152, thereby moving the valve member 41 to its open position. Exposure of the second actuator chamber 162 to the high external reference pressure does not therefore impact significantly on the opening of the valve 40.

The valve assembly may have a use in the oil and gas exploration and production industry, including but not restricted to within or as an SSTT, an SSSV, a lubricator valve assembly, a retainer valve assembly, and a valve assembly that forms part of a downhole tool. The valve assembly may however have a use in other industries.

Various modifications may be made to the foregoing without departing from the spirit or scope of the present invention.

For example, the accumulator which receives fluid exhausted from the actuator may be a first vent chamber, and the valve assembly may comprise at least one further such vent chamber. The control system may have at least one further valve closing state, in which the first vent chamber and the vent conduit may both be isolated from the actuator, and/or in which hydraulic fluid that is exhausted from the actuator during movement of the valve member to its closed position is vented to the further vent chamber. This may provide a degree of redundancy, and/or may facilitate multiple closures of the valve without requiring recovery of the valve assembly.

Whilst a vent chamber provided by an accumulator is shown in the drawings and described above, it will be understood that the vent chamber may not necessarily be provided by an accumulator and can be a simple chamber that can receive fluid exhausted from the hydraulic actuator without providing an accumulation function. The chamber may then be defined by a pressure container or vessel which is operatively connectable to the actuator. The chamber may be charged with a fluid which is at a pressure that is lower than the prevailing external pressure. Opening fluid communication between the vent chamber and the hydraulic actuator may then result in a mixing of hydraulic fluid (e.g. exhausted from the actuator) with the fluid in the vent chamber. Such mixing can potentially be avoided by employing an accumulator defining the vent chamber. In the specific example described above, this can be achieved as the compressible fluid in the second accumulator chamber can be isolated from the fluid in the first accumulator chamber (which may be hydraulic fluid).

The invention claimed is:

1. A valve assembly for controlling fluid communication along a well tubular, the valve assembly comprising:

a hydraulically operated valve comprising a valve member which is movable between an open position in which the valve member permits fluid communication along the well tubular and a closed position in which the valve member restricts fluid communication along the well tubular, and a hydraulic actuator associated with the valve member for moving the valve member between its open and closed positions;

a control system for selectively controlling the flow of hydraulic fluid to and from the hydraulic actuator, to operate the valve;

a vent chamber operatively connectable to the hydraulic actuator, for selectively receiving hydraulic fluid that is exhausted from the actuator when the valve member is moved to its closed position; and a vent conduit operatively connectable to the hydraulic actuator, for selectively receiving hydraulic fluid that is exhausted from the actuator when the valve member is moved to its closed position, the vent conduit being exposed to fluid external to the valve assembly at the prevailing external pressure;

in which the control system has a first valve closing state in which the vent chamber is isolated from the hydraulic actuator and hydraulic fluid that is exhausted from the actuator during movement of the valve member to its closed position is vented to an exterior of the valve assembly through the vent conduit;

in which the control system has a second valve closing state in which hydraulic fluid that is exhausted from the actuator during movement of the valve member to its closed position is vented into the vent chamber;

and in which the control system is configurable in a selected one of the first and second valve closing states according to an operating requirement of the valve.

2. The valve assembly of claim 1 in which, in the second valve closing state of the control system, the vent conduit is isolated from a region of the hydraulic actuator from which fluid is exhausted during closing of the valve.

3. The valve assembly of claim 1, in which the valve assembly comprises an accumulator which defines the vent chamber.

4. The valve assembly of claim 1, in which the vent chamber is a first chamber for receiving hydraulic fluid exhausted from the actuator, and the valve assembly comprises a second chamber containing a compressible fluid, and an isolating member which separates the second chamber from the first chamber.

5. The valve assembly of claim 4, in which the compressible fluid provides a reference pressure during operation of the actuator to close the valve, and the compressible fluid is at a pressure which is lower than the prevailing external pressure.

6. The valve assembly of claim 4, in which, in the second valve closing state of the control system, hydraulic fluid that is exhausted from the hydraulic actuator during movement of the valve member to its closed position is vented into the first chamber.

7. The valve assembly of claim 1, in which the control system is adapted to be configured in the second valve closing state when there is a requirement to close the valve and a component resides within a bore of the valve so that the bore is obstructed.

8. The valve assembly of claim 1, in which the control system comprises an exhaust control valve which is operable to selectively direct fluid that is vented from the actuator into one of the vent conduit and the vent chamber.

9. The value assembly of claim 8, in which the exhaust control valve is configurable in a first position in which the fluid exhausted from the actuator is directed into the vent conduit, the exhaust control valve adopting this configuration in the first valve closing state of the control system.

10. The valve assembly of claim 1, in which the control system comprises a first actuator control valve for controlling the supply of hydraulic fluid to the actuator for operating the actuator to move the valve member to its open position, and a second actuator control valve for controlling the supply of hydraulic fluid to the actuator for operating the actuator to move the valve member to its closed position.

11. The valve assembly of claim 1, in which the first actuator control valve is configurable in a first position in which the control valve communicates with a source of hydraulic fluid so that fluid is directed through the control valve to the actuator, to move the valve member to its open position, and the vent conduit is isolated.

12. The valve assembly of claim 11, in which the first actuator control valve is configurable in a second position in which the actuator communicates with the vent conduit, so that fluid which is exhausted from the actuator is directed into the vent conduit, when the control system is in its first valve closing state.

13. The valve assembly of claim 10, in which the control system comprises an exhaust control valve which is operable to selectively direct fluid that is vented from the actuator into one of the vent conduit and the vent chamber, and in which the first actuator control valve and the exhaust control valve are provided in a flow path extending to the actuator.

14. The valve assembly of claim 10, in which the second actuator control valve is provided in a flow path extending to the actuator, and in which:

when the second actuator control valve is in its first position, fluid flows from the fluid source to the actuator; and when the second actuator control valve is in its second position, fluid that is exhausted from the actuator when the valve member moves to its open position is directed into a vent conduit that is operatively connectable to the actuator.

15. The value assembly of claim 1, in which the hydraulic actuator comprises a cylinder and a piston mounted for movement within the cylinder, the piston being operatively connected to the valve member so that movement of the piston serves to move the valve member between its open and closed positions, a first chamber being defined at a first end of the cylinder and a second chamber at a second end of the cylinder, fluid being supplied to one of the first and second chambers and exhausted from the other one of the first and second chambers in order to move the piston and so operate the valve, and in which the first end of the cylinder communicates with one of the vent conduit and the vent chamber when the valve member is closed, depending upon whether the control system is in its first or second valve closing state.

16. The value assembly of claim 1, in which the valve assembly comprises a controller associated with the control system, the controller being arranged to configure the control system in one of its first and second valve closing states depending upon the operating requirement.

17. The value assembly of claim 16, in which the controller is configured to select the valve closing state for the control system according to one or more parameters, which include whether a bore of the valve is obstructed at a time when the valve member is to be moved to its closed position.

18. The value assembly of claim 17, in which:

if the valve bore is unobstructed at that time, then the controller is arranged to configure the control system in its first valve closing state so that fluid exhausted from the actuator during closing of the valve is vented to the exterior through the vent conduit; and if the valve bore is obstructed at that time, then the controller is arranged to configure the control system in its second valve closing state, so that fluid exhausted from the actuator during closing of the valve is vented to the vent chamber.

19. A control assembly for a valve that is operable to control fluid communication along a well tubular, the valve comprising a valve member which is movable between an open position in which the valve member permits fluid communication along the well tubular and a closed position in which the valve member restricts communication along the well tubular, in which the control assembly comprises:

a control system for selectively controlling the flow of hydraulic fluid to and from a hydraulic actuator of the valve, for moving the valve member between its open and closed positions to operate the valve;

a vent chamber operatively connectable to the hydraulic actuator, for selectively receiving hydraulic fluid that is exhausted from the actuator when the valve member is moved to its closed position; and a vent conduit operatively connectable to the hydraulic actuator, for selectively receiving hydraulic fluid that is exhausted from the actuator when the valve member is moved to its closed position, the vent conduit adapted to be exposed to fluid external to the valve assembly at the prevailing external pressure;

in which the control assembly has a first valve closing state in which the vent chamber is isolated from the hydraulic actuator and hydraulic fluid that is exhausted from the actuator during movement of the valve member to its closed position is vented to an exterior of the valve assembly through the vent conduit;

in which the control assembly has a second valve closing state in which hydraulic fluid that is exhausted from the hydraulic actuator during movement of the valve member to its closed position is vented into the vent chamber;

and in which the control assembly is configurable in a selected one of the first and second valve closing states according to an operating requirement of the valve.

20. A method of operating the valve assembly of claim 1 to control fluid communication along a well tubular, the method comprising the steps of:

operating the valve assembly with its valve member in the open position, to permit fluid communication along the well tubular; and on detecting a requirement to close the valve, actuating the valve member to its closed position in which the valve member restricts fluid communication along the well tubular;

in which the step of actuating the valve member to its closed position comprises assessing an operating requirement of the valve, and:

A) on determining a requirement to close the valve without performing a cutting operation, configuring the control system in its first valve closing state so that fluid that is exhausted from the actuator during movement of the valve member to its closed position is vented to an exterior of the valve assembly through the vent conduit; or B) on determining a requirement to close the valve and to perform a cutting operation, configuring the control system in its second valve closing state so that fluid that is exhausted from the actuator during movement of the valve member to its closed position is vented into the vent chamber.

* * * * *